US012163704B2

(12) United States Patent
Cline et al.

(10) Patent No.: US 12,163,704 B2
(45) Date of Patent: Dec. 10, 2024

(54) MULTI-FEED CHILLER-HEATER PRODUCTION MODULE AND METHOD OF CONTROLLING THE SAME

(71) Applicant: TRANE INTERNATIONAL INC., Davidson, NC (US)

(72) Inventors: Lee R. Cline, West Salem, WI (US); Susanna Staubly Hanson, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 12 days.

(21) Appl. No.: 17/937,065

(22) Filed: Sep. 30, 2022

(65) Prior Publication Data

US 2024/0110732 A1 Apr. 4, 2024

(51) Int. Cl.

| | |
|---|---|
| ***F24D 3/02*** | (2006.01) |
| ***F24D 3/18*** | (2006.01) |
| ***F24F 5/00*** | (2006.01) |
| ***F25B 29/00*** | (2006.01) |
| ***F25B 49/02*** | (2006.01) |

(52) U.S. Cl.

CPC ..... *F25B 29/003* (2013.01); *F24D 3/02* (2013.01); *F24D 3/18* (2013.01); *F24F 5/0003* (2013.01); *F25B 49/022* (2013.01); *F24D 2220/0207* (2013.01); *F24D 2220/044* (2013.01); *F24D 2220/046* (2013.01); *F25B 2600/0253* (2013.01)

(58) Field of Classification Search

CPC ..... F25B 29/003; F25B 2600/0253; F25B 49/022; F24D 3/02; F24D 3/18; F24D 2220/0207; F24D 2220/044; F24D 2220/046; F24F 5/0003

See application file for complete search history.

(56) References Cited

U.S. PATENT DOCUMENTS

| | | | | |
|---|---|---|---|---|
| 2012/0279681 | A1 | 11/2012 | Vaughan et al. | |
| 2018/0181150 | A1* | 6/2018 | Zuluaga | F24D 19/1003 |
| 2020/0146186 | A1* | 5/2020 | Fotouh | E04B 2/7401 |

FOREIGN PATENT DOCUMENTS

| | | | |
|---|---|---|---|
| CN | 203785320 | U | 8/2014 |
| CN | 207113222 | U | 3/2018 |

OTHER PUBLICATIONS

Fox et al., U.S. Appl. No. 17/818,552, filed Aug. 9, 2022 (36 pages).

* cited by examiner

*Primary Examiner* — Nael N Babaa
(74) *Attorney, Agent, or Firm* — HSML P.C.

(57) ABSTRACT

A packaged heating and/or cooling unit for a production module for a heating, ventilation, air conditioning, and refrigeration (HVACR) system. The packaged unit includes a heat pump configured to provide heating and/or cooling; a connection to a piping distribution system to selectively connect to a hot fluid circuit and/or a cold fluid circuit; and a controller. The controller is configured to connect to and receive a signal from a building automation system for a heating requirement or a cooling requirement, and further configured to selectively control connection to either the hot fluid circuit or the cold fluid circuit and independently control the packaged heating and/or cooling unit based on the signal from the building automation system for either the heating requirement or the cooling requirement.

15 Claims, 9 Drawing Sheets

MULTI-FEED CHILLER-HEATER PRODUCTION MODULE AND METHOD OF CONTROLLING THE SAME

FIELD

This disclosure relates generally to a heating, ventilation, air conditioning, and refrigeration (HVACR) system having an array of packaged production modules to condition a space. More specifically, the disclosure relates to systems and methods for connecting and controlling the operation of one or more packaged production modules to improve performance, efficiency, and operability of a building automation system.

BACKGROUND

A building automation system (BAS) is a computerized network of electronic devices that can be configured to control one or more systems (e.g., mechanical, electrical, lighting, security, or the like) in a building. For example, a building automation system can be configured to control a heating, ventilation, and air conditioning (HVACR) system and its components for a building. A user (e.g., a facility manager, a building maintenance engineer, or the like) typically interacts with the building automation system via a computer that is networked with a variety of unit controllers and sensors.

An HVACR system may be a hydronic system that includes e.g., an outdoor unit, etc. to provide a liquid process fluid, for example, water, a water solution, or a glycol solution, as a heat-transfer medium to condition a space in a building or occupied space. The HVACR system often includes a heat transfer circuit system that may include one or more compressors, expanders, a condenser, an evaporator, fans, filters, dampers, circulation pumps, and various other equipment. The compressor(s), the condenser, the expander, and the evaporator are fluidly connected.

Connecting multiple units or production modules of the HVACR system with the BAS can create a robust fixed system customized for a particular installation. These systems, however, often require extensive customization for connection with the BAS of the building or site to the multiple units or production modules, which is generally a labor-intensive custom task that varies with each system implementation. In some cases, necessary manual programming and other installation elements for one unit or production module may not be applicable to other systems, contributing to the costliness, non-uniform wiring and connection, and time-consuming installation associated with such systems.

SUMMARY

This disclosure relates generally to a heating, ventilation, air conditioning, and refrigeration (HVACR) system having an array of packaged production modules to condition a space. More specifically, the disclosure relates to systems and methods for connecting and controlling the operation of one or more packaged production modules to improve performance, efficiency, and operability of a building automation system.

The packaged production modules are hydronic systems in which thermal energy is exchanged with an ambient fluid in the environment, e.g., air or water, with a liquid process fluid, e.g., water, a water solution, or glycol solution, which is used to condition a space. For example, when providing cooling to the conditioned space, the production modules can exhaust heat to the ambient fluid, such as air flowed by the wind in the environment, to provide a cooled process fluid that is circulated in a cool water circuit to condition the space.

In some embodiments, a packaged heating and/or cooling unit for a production module for a heating, ventilation, air conditioning, and refrigeration (HVACR) system is provided. The packaged heating and/or cooling unit includes a heat pump configured to provide heating and/or cooling to the fluid; a connection to a piping distribution system to selectively connect to a hot fluid circuit and/or a cold fluid circuit; and a controller. The controller is configured to connect to and receive a signal from a building automation system for a heating requirement and/or a cooling requirement. The controller is also configured to selectively control connection to either the hot fluid circuit or the cold fluid circuit and independently control the packaged heating and/or cooling unit based on the signal from the building automation system for either the heating requirement or the cooling requirement.

In an embodiment, the packaged heating and/or cooling unit can further include a pump configured to pump a fluid through the packaged heating and/or cooling unit.

In some embodiments, a controller for a packaged heating and/or cooling unit for a production module for a heating, ventilation, air condition, and refrigeration (HVACR) system is provided. The controller is configured to connect to and receive a signal from a building automation system for a heating requirement and/or a cooling requirement, control connection of the packaged heating and/or cooling unit to either a hot fluid circuit or a cold fluid circuit, and independently control the packaged heating and/or cooling unit based on the signal from the building automation system for either the heating requirement or the cooling requirement. The packaged heating and/or cooling unit includes a heat pump and a connection to a piping distribution system.

In some embodiments, a method to control a packaged heating and/or cooling unit for a production module for a heating, ventilation, air condition, and refrigeration (HVACR) system is provided. The method includes connecting to and receiving a signal from a building automation system for a heating requirement and/or a cooling requirement, selectively controlling connection of the packaged heating and/or cooling unit to either a hot fluid circuit or a cold fluid circuit, and independently controlling the packaged heating and/or cooling unit based on the signal from the building automation system for either the heating requirement or the cooling requirement. The packaged heating and/or cooling unit includes a heat pump and a connection to a piping distribution system.

BRIEF DESCRIPTION OF THE DRAWINGS

References are made to the accompanying drawings that form a part of this disclosure and which illustrate the embodiments in which systems and methods described in this specification can be practiced.

Like reference numbers represent like parts throughout.

DETAILED DESCRIPTION

Figure 1A:
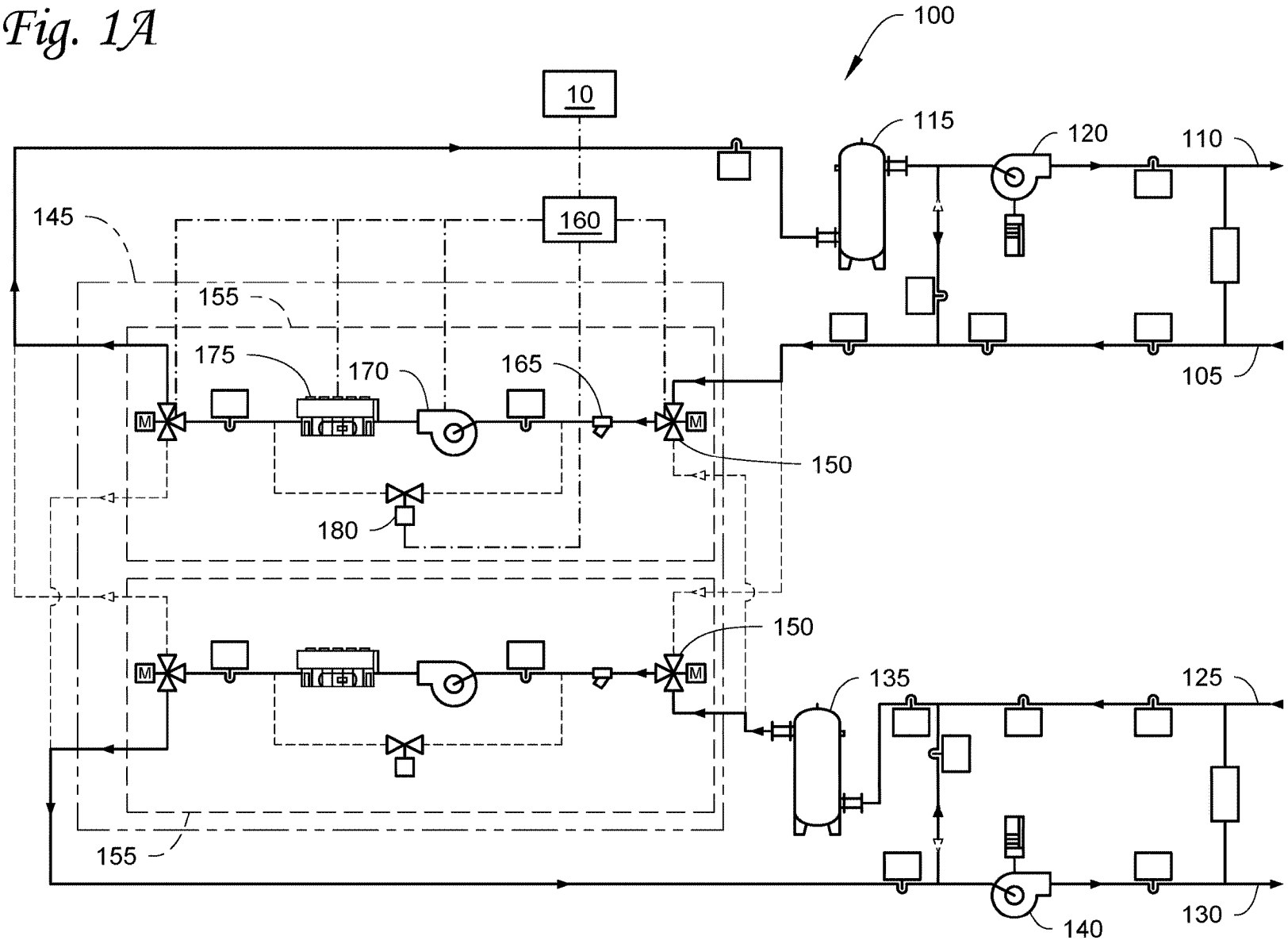
FIG. 1A illustrates a schematic diagram of a chiller-heater hydronic system, which may be implemented in an HVACR system, according to an embodiment.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Particular embodiments of the present disclosure are described herein with reference to the accompanying drawings; however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In this description, as well as in the drawings, like-referenced numbers represent elements that may perform the same, similar, or equivalent functions.

Additionally, the present disclosure may be described herein in terms of functional block components and various processing steps. It should be appreciated that such functional blocks may be realized by any number of hardware and/or software components configured to perform the specified functions.

The scope of the disclosure should be determined by the appended claims and their legal equivalents, rather than by the examples given herein. For example, the steps recited in any method claims may be executed in any order and are not limited to the order presented in the claims. Moreover, no element is essential to the practice of the disclosure unless specifically described herein as "critical" or "essential."

The following definitions are applicable throughout this disclosure. As defined herein, the term "building automation system" or "BAS" may refer to a system used to coordinate, manage, and automate control of diverse environmental, physical, and electrical building subsystems, particularly HVACR systems and climate control and which may also include security, lighting, power, and the like. It will be appreciated that different embodiments of the BAS are described in U.S. Pat. No. 10,269,235, which is hereby incorporated by reference.

As defined herein, the term "points" or "points of control" or "control points" may refer to sensor inputs, control outputs, or control values (of a controller), with different characteristics according to manufacturer. In an embodiment, the inputs and outputs of a controller may be referred as control points of the controller. A "point" may refer to a control operation, such as a sensing action (e.g., sensor input), a controlling action (e.g., control output), or the like. For example, a point may include a temperature sensor input, an output of a proportional controller operating a control valve, or the like.

A HVACR system can include a plurality of production modules to provide the necessary heating and/or cooling to condition a space in a building. The HVACR system and/or the production modules can be connected with the BAS system and main controller to control the HVACR system and its components to provide heating and/or cooling to a building.

An issue associated with installing prior production modules in the HVACR system is the complexity of setting up the control of components of the production module and the system control coordination with the BAS main controller. In some cases, such production modules, if connected or set up incorrectly, can be prone to control errors that can compromise system operation and equipment reliability.

In order to overcome such problems, the present disclosure relates to systems and methods for connecting and controlling production modules to improve performance, efficiency, and operability of a building automation system, e.g., dynamically extensible and automatically configurable with the BAS. The systems and methods enable a user to install the production module into the HVACR system and plug into the connection of the BAS main controller to be able to provide heating and/or cooling to the conditioned space without having to connect each end device or component of the production module to the BAS main controller directly.

Generally, a BAS includes a main controller, one or more controllers, and one or more sensors that are connected via a network. A controller and a sensor can compose a subsystem of the building or be a component of the HVACR system. A subsystem of the building can similarly be composed of a controller and a plurality of sensors, or a plurality of controllers and a plurality of sensors that have the same communication protocols.

The BAS main controller can be hardwired or use a proprietary communication standard or protocol to link the various subsystems and provide system-wide user access, monitoring, and control. In some embodiments, the main controller can communicate with the sensors and controllers via a token passing protocol, such as BACnet (Building Automation and Control Networking Protocol), or another suitable communication protocol. In other embodiments, some of the devices can communicate via wireless communications while others can communicate via BACnet, or other suitable communication protocol.

The main controller can, in some embodiments, receive and transmit data from/to a unit controller or central controller (discussed below). For example, the main controller can receive data regarding the operating status of the one or more unit controllers. In some embodiments, the main controller can schedule and coordinate the various systems of the building. For example, the main controller can be configured to maintain the building, or parts thereof, at a first temperature during a first time period and a second temperature during a second time period by having at least one of a temperature sensor, thermostat, or other similar sensor, be in communication with a variable air volume (VAV) controller (the unit controller) in order to control airflow (and therefore climate) into a zone (e.g., a single room, a plurality of rooms, a wing of a building, or the like) of the building including the sensor (e.g., to maintain a desired temperature, humidity, or the like).

The main controller is in communication with the one or more controllers, the one or more sensors, and a user interface via a network. The network can, for example, include physical and/or wireless connections. For example, the network can be a local area network (LAN) and some of the devices can be physically connected to each other via Ethernet cables or the like. In some embodiments, the network can include a wireless network, such as through a wireless network router. In some embodiments, the network can include a combination of physical and wireless connections.

While some of the devices of the BAS system can be physically or wirelessly connected to the BAS main controller, the production module of the HVACR system and its components thereof are connected to the BAS main controller via a unit controller or central controller so that the unit controller or central controller independently controls its own unit components or devices. The production modules may include any one of feed valves, return valves, tempering valves, strainers, sensors, unit and/or central controllers, pumps, and/or heat pumps to be a standalone hydronic heating/cooling unit that are independently controlled by the unit controller or central controller apart from the BAS main controller. The heat pump can be an air-source heat pump, water-to-water heat pump, or multipipe unit. The unit controller or central controller is provided on the production module and programmed to locally and/or distributively control the production module based on a control signal from the BAS. As such, the BAS does not control the individual components of the production module, but rather, provides a control signal, such as, a set point or operational mode, e.g., cooling or heating, needed for the conditioned space that is sent to the production module. By integrating the unit controller or central controller into the production module, not only is the design of, connection to, and control of the production module simplified, the repeatability, standardization of connections, and sustainability of the control is increased and a more responsive control is provided, as discussed below.

FIG. 1A shows a schematic of a chiller-heater hydronic system 100 for conditioning a space using a HVACR system. The chiller-heater hydronic system 100 includes a piping distribution system that includes a hot water circuit that includes hot water return line 105, hot water supply line 110, hot water tank 115, and hot water distribution pump 120, and a cold water circuit that includes cold water return line 125, cold water supply line 130, cold water tank 135, and cold water distribution pump 140, and a plurality of sensors and/or elements providing in the process fluid lines of the piping distribution system for measuring an environmental condition, such as temperature or pressure, or a flow rate. It is appreciated that in addition to the hot water circuit and the cold water circuit, in a non-limiting example, additional water circuits may be provided at different temperatures, for example, a cooler water circuit or warmer water circuit. Additionally, while water is discussed herein with respect to the hydronic system, it is appreciated that other solutions for the liquid process fluid may be circulated, for example, glycol solution, water solution, or the like for conditioning the space using the HVACR system. While the components of the piping distribution system are illustrated, it is appreciated that the illustrated embodiment is not intended to limit the scope of the disclosure. Rather, different elements can be positioned having different piping arrangements. For example, while the cold water tank 135 is illustrated as being positioned prior to the production module, to moderate the water temperature changes to the production module, the cold water tank 135 can be positioned after the production module (e.g., described further below as 145) to provide buffering for the cold water circuit. Additional components can also be included, such as additional tanks, etc.

The chiller-heater hydronic system 100 can generally be applied in a variety of systems used to control an environmental condition (e.g., temperature, humidity, air quality, or the like) in a conditioned space. The conditioned space can be a space within an office building, a commercial building, a factory, a laboratory, a data center, a residential building, or the like. In an embodiment, the chiller-heater hydronic system 100 can be configured to be a cooling system (e.g., an air conditioning system) capable of operating in a cooling mode. In an embodiment, the chiller-heater hydronic system 100 can be configured to be a heat pump that can operate in a heating/defrost mode. It is appreciated that the chiller-heater hydronic system 100 can be configured to operate in a cooling mode and a heating/defrosting mode.

Figure 1B:
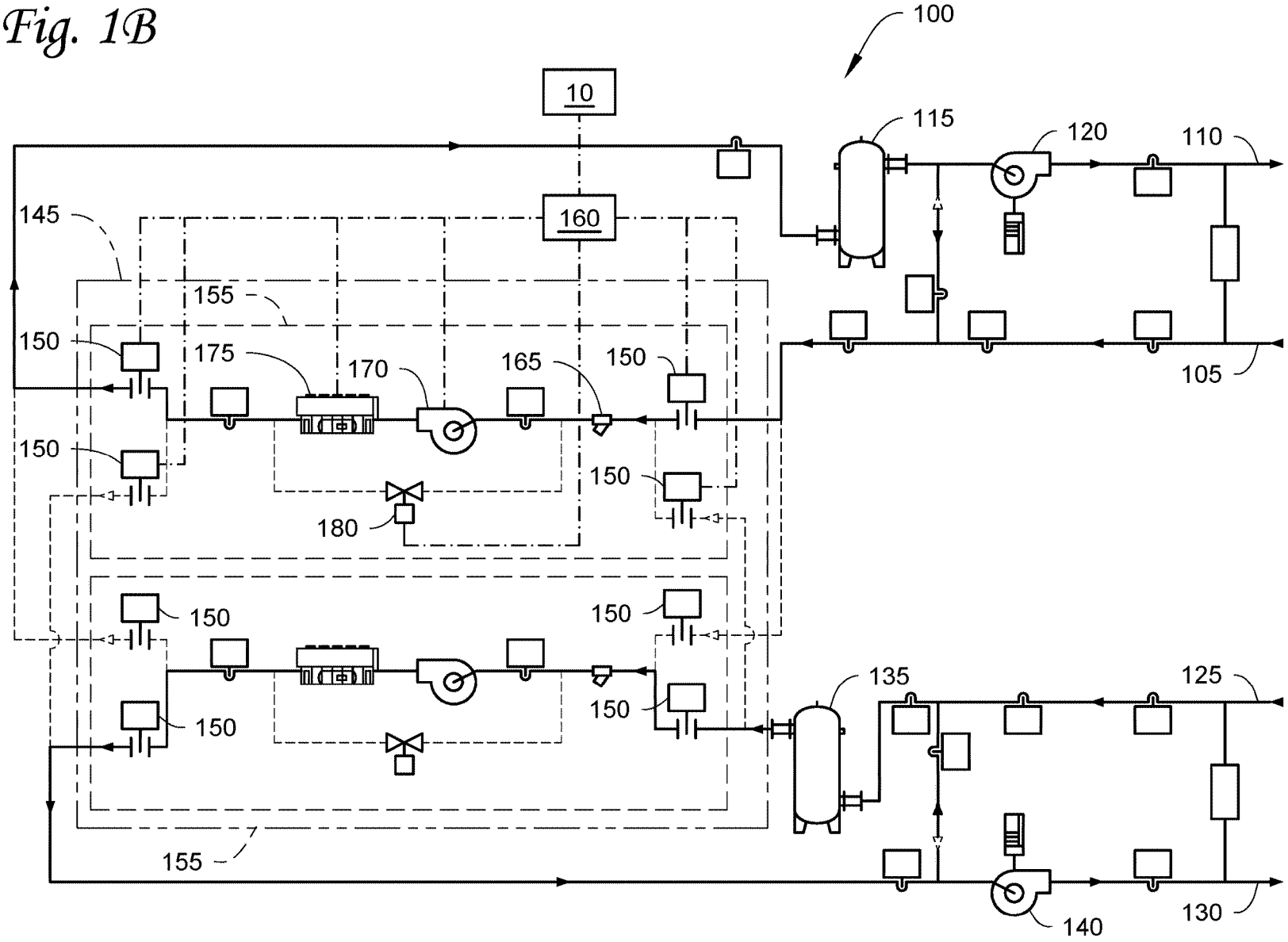
FIG. 1B illustrates a schematic diagram of a chiller-heater hydronic system according to another embodiment.

The chiller-heater hydronic system 100 further includes at least one production module 145 that includes a connection, such as a boss fitting, push to connect fitting, cam lock fitting, valve fittings, threaded fitting, or the like, to connect to the hot water circuit and the cold water circuit. The connection may include a three-way feed valve 150, e.g., two position valve, and a three-way return valve 150, e.g., a two position valve, to allow the reversible connection of the production module to either the hot water circuit or the cold water circuit. In an embodiment, the three-way feed valve 150 may be connected to the inlet of the production module and the three-way return valve 150 may be connected to the outlet of the production module or provided integrated with the production module to allow connection to the hot water circuit and the cold water circuit. In another embodiment, as illustrated in FIG. 1B, two 2-way feed valves 150 can be connected to the inlet and outlet of the production module to provide changeover of the production module to and from the cooling and heating distribution loops, in place of the three-way change over valve 150 as illustrated in FIG. 1A. While, in an embodiment, the at least one production module 145 will be discussed below as relating to one unit, the production module 145 may include multiple packaged heating and/or cooling units 155 that are connected in parallel with other packaged heating and/or cooling units 155.

Each of the packaged heating and/or cooling units 155 can include any one of a combination of a unit controller 160, strainer 165, a pump 170, a heat pump 175, a tempering valve 180, a plurality of sensors or elements for measuring an environmental condition, for example, the temperature or pressure of the process fluid or temperature of pressure within the packaged unit, e.g., refrigerant temperature or pressure or ambient fluid temperature, e.g., air or water temperature, or a flow rate, and/or the feed valve(s) 150 and the return valve(s) 150. The strainer 165 is provided at an exit of the feed valve(s) 150 and receives the process fluid to filter contaminants, such as debris, build-up, corrosion products, or the like. The strainer 165 can include a body housing a filter membrane or unit. Pump 170 can be a variable speed process fluid pump to control the amount of flow through the heat pump 175 based on heat transfer principles, such as, $Q=mC_p\Delta T$. Process fluid pump 170 may be a centrifugal pump, diaphragm pump, piston pump, or the like. Tempering valve 180 is provided around the heat pump 175 to help control or temper a temperature of the process fluid entering the heat pump 175, e.g., a tempering valve. Tempering valve 180 may be a solenoid valve or an adjustable valve to control the amount of process fluid flow around the heat pump 175. While the packaged heating and/or cooling unit 155 is discussed above, such disclosure is not intended to be limiting in scope. In an embodiment, the packaged heating and/or cooling unit 155 can include the unit controller 160 and heat pump 175, and the feed valve(s) 150 and return valve(s) as a packaged unit provided on a skid and/or frame based on the layout and/or configuration of the chiller-heater hydronic system 100, e.g., space or availability for placement of the packaged heating and/or cooling unit 155. The remaining component(s), e.g., heat pump components, pump 170, tempering valve 180, or the like, can be provided as standalone parts or as a separate packaged unit that can be connected to the packaged heating and/or cooling unit 155 and unit controller 160. As such, it is understood that the disclosure of the components of the packaged heating and/or cooling unit 150 is not limiting, but intended to allow flexibility of the system that has plug-and-ready design capabilities to meet customer demands for different configurations and layouts for any chiller-heater hydronic system.

The heat pump 175 can be an air-cooled heat pump, which includes a compressor for compressing a working fluid of the packaged heating and/or cooling units, a condenser, expander, and evaporator. The compressor, the condenser, the expander, and the evaporator can be fluidly connected.

The heat pump 175 can operate according to generally known principles. The heat pump 175 can be configured to heat and/or cool the hydronic HVACR system process fluid. In some embodiments, the heat pump 175 can operate as a vapor-compression circuit such that the compressor compresses a working fluid (e.g., a heat transfer fluid such as, but not limited to, refrigerant or the like) from a relatively lower pressure gas to a relatively higher-pressure gas. The relatively higher-pressure gas is at a relatively higher temperature, being discharged from the compressor and flowing through the condenser. In accordance with generally known principles, the working fluid flows through the condenser and rejects heat to the process fluid (e.g., water, air, etc.), thereby cooling the working fluid. The cooled working fluid, which is now in a liquid form, flows to the expander that can reduce the pressure of the working fluid. As a result, a portion of the working fluid is converted to a gaseous form. The working fluid, which is now in a mixed liquid and gaseous form flows to the evaporator. The working fluid flows through the evaporator and absorbs heat from the process fluid (e.g., a heat transfer medium such as, but not limited to, water, a solution, air, etc.), heating the working fluid, and converting it to a gaseous form. The gaseous working fluid then returns to the compressor. The above-described process continues while the heat transfer circuit is operating, for example, in a cooling mode (e.g., while the compressor is enabled).

The compressor may be, for example, a centrifugal compressor, scroll compressor, screw compressor, or any other suitable type of compressor for use in a working fluid circuit. The compressor can be controlled by unit controller 160, for example to adjust operation of the compressor such as the capacity at which the compressor is operated and/or any other suitable controls for operation of the compressor. In an embodiment, multiple compressors may be included in packaged heating and/or cooling unit 155.

The condenser includes a heat exchanger. The condenser receives compressed working fluid from the compressor, and the working fluid rejects heat via the heat exchanger at the condenser. The rejection of heat at the condenser condenses the working fluid to a liquid. The condenser may be in thermal communication with an ambient environment or a source fluid, and reject heat to that ambient environment or source fluid. One or more condenser fans may provide airflow over the condenser. The operation of the one or more condenser fans may be controlled by unit controller 160. Operation of the condenser fans by unit controller 160 can be used at least in part to control the capacity at which the packaged heating and/or cooling units 155 is operated.

The expander is configured to reduce the pressure of the working fluid. As a result, a portion of the working fluid is converted to a gaseous form. The expander may be, for example, an expansion valve, orifice, or other suitable expander to reduce pressure of a refrigerant such as the working fluid. In an embodiment, the expander includes multiple orifices. In an embodiment, the multiple orifices of the expander have different sizes. The expander may be a controllable expander having a variable aperture. In an embodiment, the expander is an electronic expansion valve. The expander may be controlled by unit controller 160 to adjust its effects on flow and expansion of the working fluid, for example by controlling aperture size of an expansion valve or the number and size of orifices in use based on a signal from unit controller 160. Control of the expander by unit controller 160 can be used at least in part to control the capacity at which the packaged heating and/or cooling units 155 is operated.

The evaporator receives working fluid from the expander. The evaporator includes a heat exchanger where the working fluid can absorb heat, for example absorbing heat from a liquid process fluid that can be used to provide cooling to an area served by the packaged heating and/or cooling units 155. This process fluid exchanges heat with the working fluid in the evaporator, which absorbs heat from the process fluid and evaporates the working fluid.

It is understood that the packaged heating and/or cooling units 155 can be used to provide heating and/or cooling. As such, while the condenser and evaporator are discussed above with respect to the packaged heating and/or cooling unit 155 operating in a cooling mode, it is appreciated that if the packaged heating and/or cooling unit 155 is operated in a heating mode, the condenser and evaporator would operate in reverse order.

The packaged heating and/or cooling unit 155 can include a housing (or enclosure) configured to contain one or more components or end devices of the system, such as, the compressor, the condenser, the expander, the evaporator, the pump, the strainer, the tempering valve, and/or the feed valve(s) and return valve(s), or the like. The packaged heating and/or cooling unit 155 can be considered as a single unit and be supported by a frame and/or provided on a skid platform. It will be appreciated that other packaged designs, layouts, and specific configurations may be employed.

Unit controller 160 is a controller that controls the components of the packaged heating and/or cooling units 155. Unit controller 160 can include spare input/outputs and programmability to enable receiving and/or receiving a signal from the BAS main controller 10 to heat or cool. As such, unit controller 160 can direct operation of components of the unit including, as non-limiting examples, the pump 170, tempering valve 180, the heat pump 175, including but not limited to the compressor, the expander, condenser fan(s), the feed valve(s) 150 and return valve(s) 150, or the like, such that the BAS main controller 10 does not have to control each component. Unit controller 160 can include one or more processors and one or more storage memories. It is appreciated that when the production module 145 includes multiple packaged heating and/or cooling units, a central controller (not shown) may be provided that controls each of the packaged heating and/or cooling units by sending a single to the respective unit controller, e.g., the unit controller is connected to the central controller in a daisy-chain arrangement. In another embodiment, the central controller (e.g., as described below as 400, 500, 600) of the production module 145 directly controls each of the packaged heating and/or cooling units.

In some prior designs of HVACR systems, the main controller of the BAS is in communication directly with end devices, which may include a range of HVACR equipment such as plants/modules, chillers, air handlers, furnaces, or boilers with multiple data sensors producing a continuous stream of data, variable air volume (VAV) boxes and dampers, temperature or humidity sensors monitoring a space, etc.

In the embodiments discussed herein, however, the BAS main controller 10 does not communicate directly with the end devices, but rather communicates with the unit controller 160 (or central controller of the production module 145). As such, the unit controller 160 distributively controls any of the end devices, such as the pump 170, heat pump 175, including compressor, or fans, and/or the feed valve(s) 150 and return valve(s) 150 to provide the operational control requested by the BAS main controller 10, e.g., heating or cooling. As such, since the unit controller 160 has the requisite communication protocol to communicate with the BAS main controller 10, each of the individual components or end devices of the packaged heating and/or cooling unit 155 does not have to be hardwired or otherwise connected to the BAS main controller 10, but rather, only communicates with the unit controller and/or the central controller associated with the packaged heating and/or cooling unit. In so doing, the problems associated with the prior production modules, including the complexity of configuring each of the end devices coordination thereof with the BAS main controller 10 and control errors, if connected or set up incorrectly, may be avoided. Such a design of the unit controller also has the added benefit of allowing the packaged heating and/or cooling unit to be a plug-and-ready design, in which once, a packaged unit is placed within the HVACR system and connected to the piping distribution system, and the unit controller is connected to the BAS main controller 10, the packaged unit is ready for operation in a quick and efficient manner. That is, since the end devices or components of the packaged heating and/or cooling unit 155 only communicate with the unit controller (or central controller), a simplified control interface is provided, in which the unit controller 160 has decision making capabilities for optimizing the packaged heating and/or cooling unit at the chiller/heater level, e.g., higher level pattern control or quasi-distributed control to allow system coordination at the production module level. For example, if a new end device or component is added to the packaged heating and/or cooling unit 155, for example, an economizer, the economizer only has to be connected to communicate with the unit controller 160, and the unit controller 160 can determine operation at the chiller/heater level to best control the packaged heating and/or cooling unit 155. In another embodiment, such a distributed system allows the connection of multiple packaged heating and/or cooling units 155 to the production module 145. As such, either the unit controller 160 of each of the packaged heating and/or cooling unit 155 is connected to the central controller of the production module 145 to receive the signal from the BAS main controller 10 or the components or devices of the packaged heating and/or cooling unit 155 are connected to the central controller and the central controller is programmed to control the components or devices.

Example embodiments with respect to the production module 145 and control of the packaged heating and/or cooling unit 155 is further discussed below.

In an embodiment, production module 145 can include at least one packaged heating and/or cooling unit 155. In another example embodiment, production module 145 can include at least two packaged heating and/or cooling units 155, in which one unit can be operated in a heating mode and one unit can be operated in a cooling mode to provide the necessary heating and/or cooling needs for conditioning the spaces for the HVACR system. The control of the packaged heating and/or cooling unit 155 is discussed below as a non-limiting example, but provided to provide an exemplary example.

Figure 2:
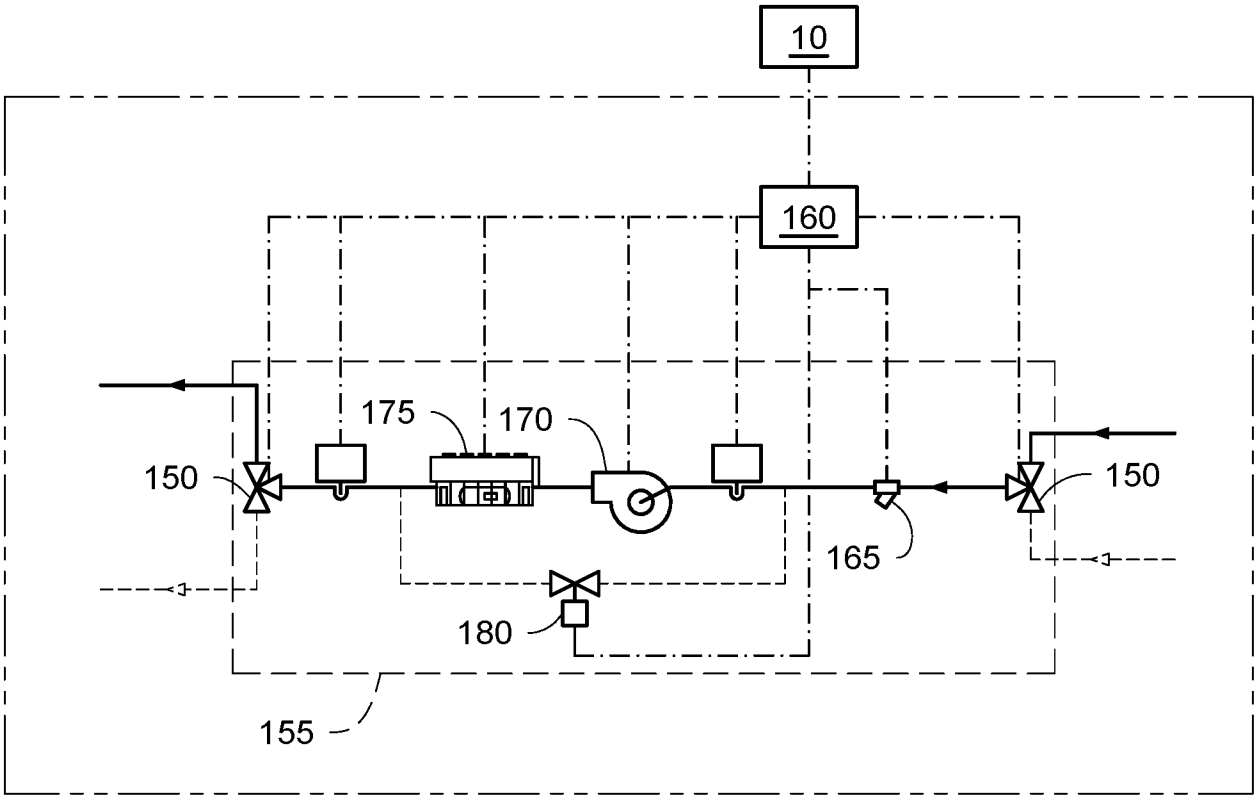
FIG. 2 is a schematic view of a packaged unit of a chiller-heater hydronic system, according to an embodiment.

In an embodiment, as seen in FIG. 2, the unit controller 160 can receive a control request to operate in a heating mode from the BAS main controller 10 for heating a conditioned space, e.g., in the building. The unit controller 160 can instruct the feed valve(s) 150 to connect to the hot water return line 105 to feed the hot water return to the packaged heating and/or cooling unit 155 and the return valve(s) 150 to connect to the hot water supply line 110 to supply the heated hot water supply. The unit controller 160 can also instruct or confirm that the heat pump 175 is operating in a heating mode, e.g., a configuration in which the refrigerant absorbs heat from the ambient environment. The unit controller 160 can control the operation of pump 170 to provide a flow of the process fluid to the heat pump 175.

In an embodiment, the BAS main controller 10 can instruct the unit controller 160 to provide hot water at a given set point, e.g., between 130 and 180° F., or that a heating load is required. As such, the unit controller 160 may optimize the packaged heating and/or cooling unit 155 to maximize its system component capabilities. For example, based on an optimal compression ratio of the compressor of the heat pump 175 based on the ambient temperature, the compressor may be run at maximum speed while a controlled amount of the hot water return fluid is provided in heat exchange with the condenser of the heat pump 175, e.g., to avoid a defrosting event at low ambient temperatures. In view of the operating limits of the heat pump 175, e.g., minimum temperature at which the heat pump 175 can heat, the unit controller 160 may control the tempering valve 180 to recirculate the fluid from the heat pump 175 exit back to the supply line of the heat pump 175 to keep the heat pump 175 operating at the desired operating regime.

In another embodiment, the unit controller 160 can monitor the pressure of the process fluid. As such, when the unit controller 160 receives the control signal from the BAS main controller 10, the unit controller 160 can monitor and optimize the packaged heating and/or cooling unit 155 to maintain the hot water set point. For example, if a pressure after the strainer 165 increases due to pluggage of the strainer 165, the unit controller 160 can operate at least one of the pump 170 and the compressor of the heat pump 175, to optimize the flow through the packaged unit 155 and make sure the packaged unit 155 flow limitations are maintained, e.g., temperature and/or operational limitations of the heat pump and/or set point requirements for the HVACR system. For example, since the flow of process fluid is lowered due to a pluggage of the strainer, the unit controller 160 can control the speed of the compressor of the heat pump 175 to compensate for the lower flow rate in the heat exchanger.

Figure 3:
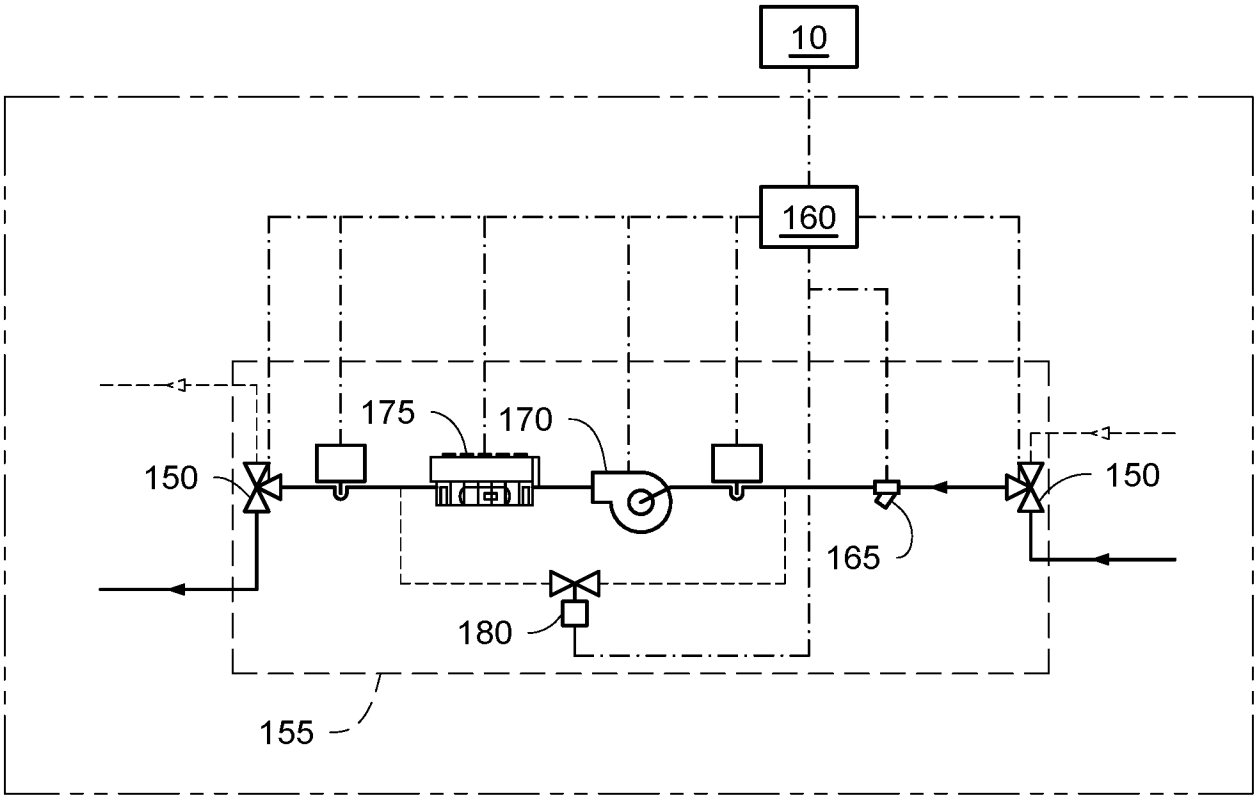
FIG. 3 is a schematic view of a packaged unit of a chiller-heater hydronic system, according to an embodiment.

In another embodiment, as seen in FIG. 3, the unit controller 160 can receive a control request to operate in a cooling mode from the BAS main controller 10 for cooling a conditioned space, e.g., in the building. The unit controller 160 instructs the feed valve(s) 150 to connect to the cold water return line 125 to feed the cold water return to the packaged heating and/or cooling unit 155 and the return valve(s) 150 to connect to the cold water supply line 130 to supply the cooled cold water supply. The unit controller 160 can also instruct or confirm that the heat pump 175 is operating in a cooling mode, e.g., a configuration in which the refrigerant releases heat to the ambient environment. The unit controller 160 can also operate pump 170 to provide a flow of the process fluid to the heat pump 175. In view of the operating limits of the heat pump 175, e.g., the maximum temperature at which the heat pump 175 can cool, the unit controller 160 may control the tempering valve 180 to recirculate the fluid from the heat pump 175 exit back to the supply line of the heat pump 175 to keep the heat pump 175 operating at the desired operating regime, e.g., to temper the entrance fluid temperature.

In the embodiments as discussed above, it is understood that the same packaged heating and/or cooling unit 155 can be selectively operated in a heating mode or cooling mode, based on the operation of the heat pump, e.g., using a reversing valve, and is able to be selectively controlled to connect to either the hot water circuit or the cold water circuit. As such, a simple and flexible design of a packaged heating and/or cooling unit having any combination of a heat pump, condenser, expander, evaporator, fluid pump, feed valve(s), and/or return valve(s) is provided that has plug-and-ready design type connections into the production module and/or the HVACR system. As such, it is understood that the packaged heating and/or cooling unit can be locally and/or distributively controlled by the unit controller or central controller based on a control signal from the BAS. As such, the BAS does not control the individual components of the production module, but rather, provides a control signal, such as, a set point or operational mode, e.g., cooling or heating, needed for the conditioned space that is sent to the production module. By integrating the unit controller or central controller into the production module, not only is the design of, connection to, and control of the production module to the BAS simplified, the repeatability, standardization of connections, and sustainability of the control is increased and a more responsive control is provided, as discussed below. Furthermore, such a design allows the packaged heating and/or cooling unit be self-modulating such that the components of the individual packaged heating and/or cooling unit are controlled based on their own operational limitations/conditions.

Figure 4:
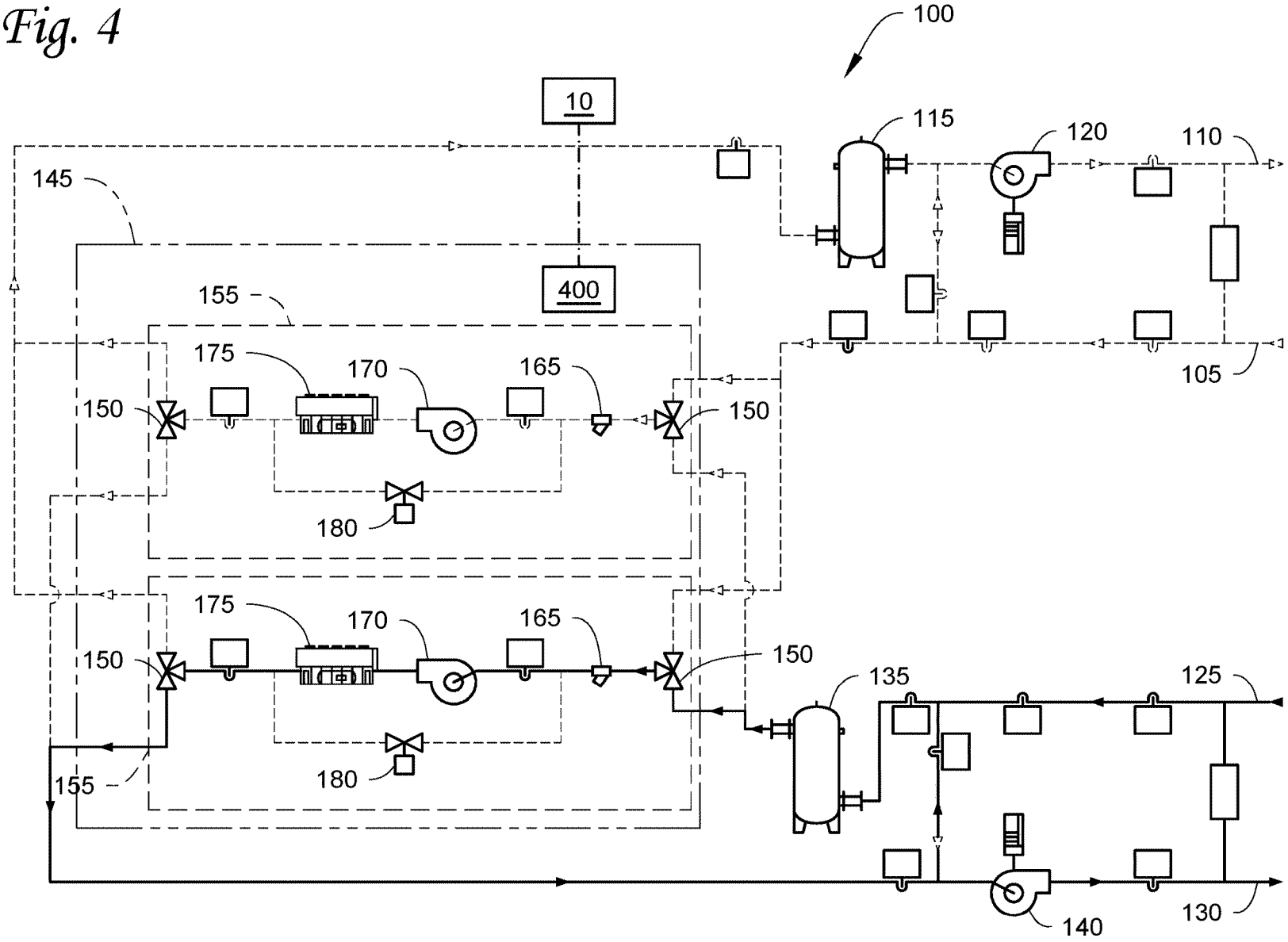
FIG. 4 illustrates a control of a chiller-heater hydronic system in a cooling mode, according to an embodiment.

In another example embodiment, as illustrated in FIG. 4, the production module 145 includes at least two packaged heating and/or cooling units 155. In this embodiment, the production module 145 can include a central controller 400 that controls each of the packaged heating and/or cooling units 155 by sending a signal to the respective unit controller 160, e.g., the central controller 400 receives the control signal from the BAS controller 10 and sends or relays the control to the respective unit controller 160 of the respective packaged heating and/or cooling unit 155. In another embodiment, the central controller 400 of the production module 145 directly controls each of the end devices or components of the packaged heating and/or cooling units and is connected to each of the sensors in the packaged heating and/or cooling units 155, e.g., the central controller 400 is factory installed to control the end devices or components installed for the production module 145 and the packaged heating and/or cooling units 155. In an embodiment, the production module 145 can be considered as a single unit and be supported by a frame and/or provided on a skid platform, in which the production module 145 is connected to the piping of the hydronic HVACR system. It will be appreciated that other packaged designs, layouts, and specific configurations may be employed.

As shown in FIG. 4, only one of the packaged heating and/or cooling units 155 is operating in a cooling mode, while the other packaged heating and/or cooling unit 155 is not operational. That is, the BAS main controller 10 sends a cooling control request, e.g., setpoint or operational mode, to the production module 145 to cool a conditioned space. The central controller 400 and/or the unit controller instructs the heat pump 175 to operate in a cooling mode and instructs the feed valve(s) 150 to connect to the cold water return line 125 to feed the cold water return to the packaged heating and/or cooling unit 155 and return valve(s) 150 to connected to the cold water supply line 130 to supply the cooled cold water return. The central controller 400 and/or the unit controller can also control operation of pump 170 to provide a flow of the process fluid to the heat pump 175.

The packaged heating and/or cooling unit 155 can be connected to the cold water circuit and controls the process fluid as a variable flow control using the feed valve(s) 150 and return valve(s) 150 and/or varying the speed of the pump 170 based on a temperature or pressure in the system. In an embodiment, optimization strategies such as critical-valve pump pressure optimization may be applied per required codes to optimize the operation of the packaged heating and/or cooling distribution system.

In an embodiment, the production module 145 is provided a cold water setpoint from the BAS main controller 10 for conditioning the space(s) of the HVACR system. The use of the other packaged heating and/or cooling unit 155 may be based on optimization strategies such as chilled water temperature reset if appropriate for the chilled water distribution and air-side system design. For example, the production module 145 and pumps 170 are controlled in the cooling mode flow, which would be typical if the cold water circuit flow rate is close to (e.g., equal to) or higher than a minimum allowed flow of the heat pump 175, e.g., evaporator operational limits. For example, when the evaporator's design flow is at a predetermined flow rate, e.g., eighty percent or more, higher than its minimum allowed flow, or when the first unit is close to or at full load, the central controller 400 may instruct the other packaged heating and/or cooling unit 155 to operate in a cooling mode to supplement the cooling of the process fluid in the cold water circuit, e.g., using a variable primary/variable secondary flow control logic. As such, the other packaged heating and/or cooling unit 155 is not only provided as a back-up packaged heating and/or cooling unit 155 in case the primary packaged heating and/or cooling unit 155 fails, but is provided as a supplemental packaged heating and/or cooling unit to provide the necessary cooling and/or to optimize the control of the production module 145. For example, the variable primary/ variable secondary flow control logic reduces the annualized pumping energy consumption and cost, and the control is easier to implement and sustainable. It is also appreciated that the supplemental use of the packaged heating and/or cooling unit 155 can be provided for the safe operation of the system, e.g., to ensure the hydronic system is operating at its operability limits. For example, based in the design flow of the pumps 170 and/or heat pumps 175, the supplemental use of the packaged heating and/or cooling unit 155 may be operational in a staged manner to control the amount of fluid flow to both packaged heating and/or cooling units 155, e.g., pumps may need to rebalance fluid flow to ensure proper operation of the packaged heating and/or cooling unit 155.

Figure 5:
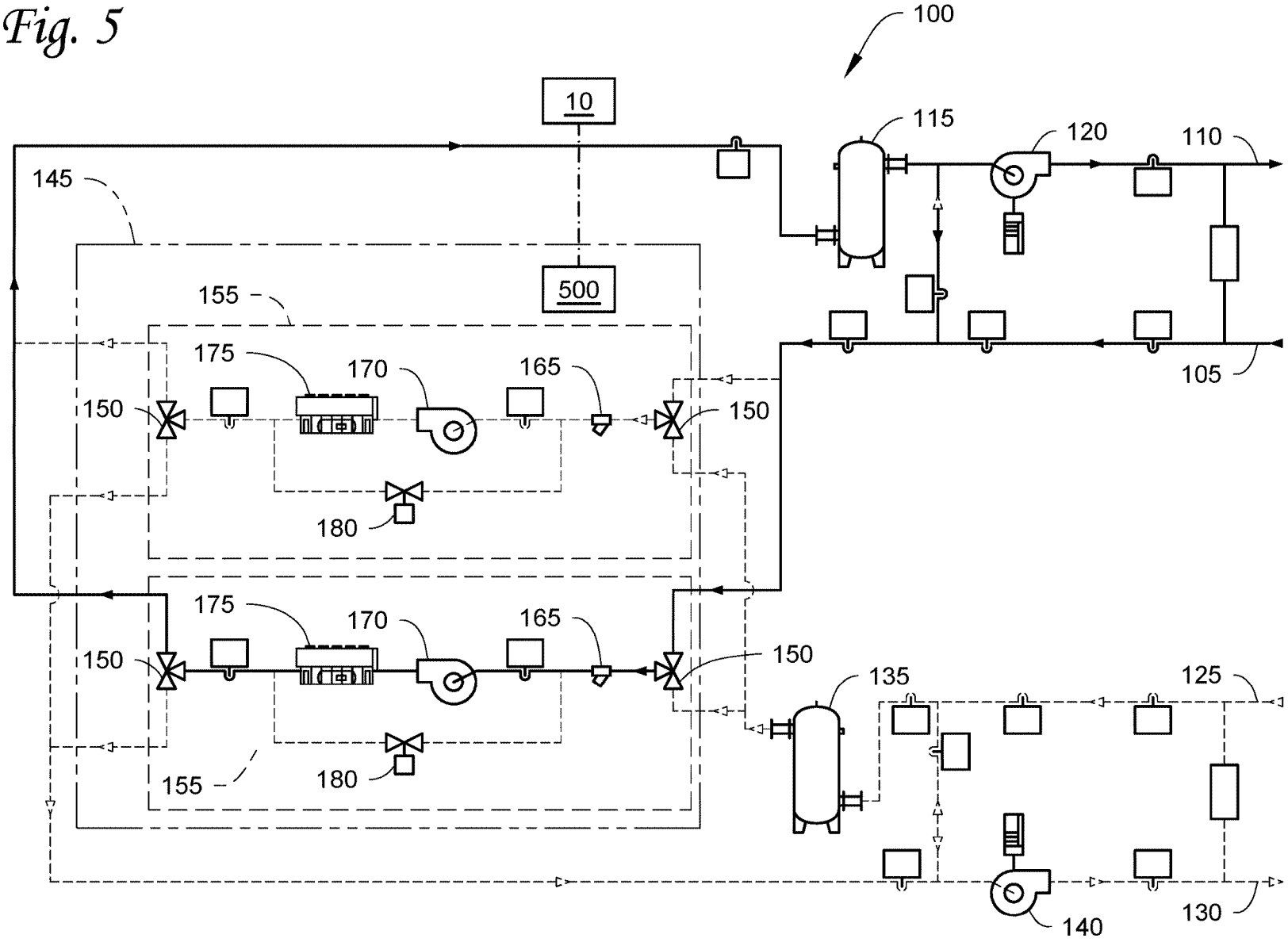
FIG. 5 illustrates a control of a chiller-heater hydronic system in a heating mode, according to an embodiment.

FIG. 5 illustrates another example embodiment, similar to the embodiment of FIG. 4, in which the production module 145 includes at least two packaged heating and/or cooling units 155. The production module 145 can include a central controller 500 that controls each of the packaged heating and/or cooling units 155 by sending a signal to the respective unit controller. In another embodiment, the central controller 500 of the production module 145 directly controls each of the end devices or components of the packaged heating and/or cooling units 155 and is connected to each of the sensors in the packaged heating and/or cooling units 155.

As shown in FIG. 5, only one of the packaged heating and/or cooling units 155 is operating in a heating mode, while the other packaged heating and/or cooling unit 155 is not operational. That is, the BAS main controller 10 sends a heating control request, e.g., setpoint or operational mode, to the production module 145 to heat a conditioned space. The central controller 500 and/or the unit controller instructs the heat pump 175 to operate in a heating mode and instructs the feed valve(s) 150 to connect to the hot water return line 125 to feed the hot water return to the packaged heating and/or cooling unit 155 and the return valve(s) 150 to connect to the hot water supply line 110 to supply the heated hot water supply. The central controller 500 and/or the unit controller can control operation of pump 170 to provide a flow of the process fluid to the heat pump 175.

The packaged heating and/or cooling unit 155 can be connected to the hot water circuit and control the process fluid as a variable flow control using the feed valve(s) 150 and return valve(s) 150 and/or varying the speed of the pump 170 based on a temperature or pressure in the system. In an embodiment, optimization strategies such as critical-valve pump pressure optimization may be applied per required codes to optimize the operation of the packaged heating and/or cooling system.

In an embodiment, the production module 145 is provided a hot water setpoint from the BAS main controller 10 for conditioning a space in the HVACR system. The use of the other packaged heating and/or cooling unit 155 may be based on optimization strategies such as hot water temperature reset if appropriate for the hot water distribution and air-side system design. For example, the packaged heating and/or cooling unit 155 and pump 170 are controlled in the heating mode flow, which would be typical if the hot water circuit flow rate is close to (e.g., equal to) or higher than the minimum allowed flow of the heat pump 175, e.g., condenser operational limits. For example, when the condenser's design flow is at a predetermined value, e.g., eighty percent or more, higher than its minimum allowed flow, or when the first unit is close to or at full load, the central controller 500 may instruct the other packaged heating and/or cooling unit 155 to operate to supplement the heating of the process fluid in the hot water circuit, e.g., using the variable primary/variable secondary flow control logic. As such, the other packaged heating and/or cooling unit 155 is not only provided as a back-up packaged heating and/or cooling unit 155 in case the primary packaged heating and/or cooling unit 155 fails, but is provided as a supplemental packaged heating and/or cooling unit to provide the necessary heating and/or to optimize the control of the production module 145. For example, the variable primary/variable secondary flow control logic reduces the annualized pumping energy consumption and cost, and the control is easier to implement and sustainable.

Figure 6:
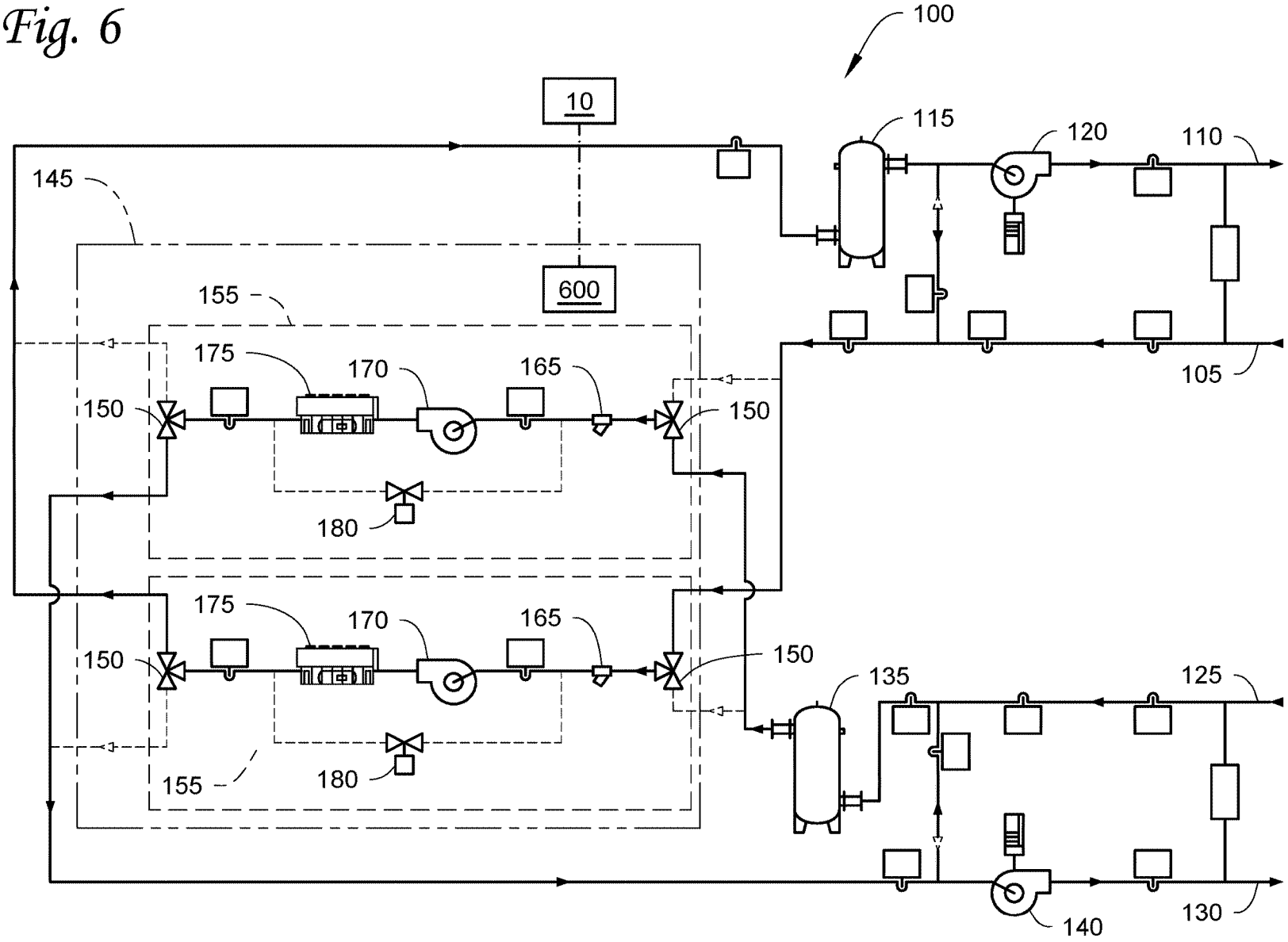
FIG. 6 illustrates a control of a chiller-heater hydronic system in both a heating mode and cooling mode, according to an embodiment.

In yet another non-limiting example, as illustrated in FIG. 6, the production module 145 includes at least two packaged heating and/or cooling units 155 to provide simultaneous heating and cooling. The production module 145 can include a central controller 600 that controls each of the packaged heating and/or cooling units 155 by sending a signal to the respective unit controller. In another embodiment, the central controller 600 of the production module 145 directly controls each of the end devices or components of the packaged heating and/or cooling units 155 and is connected to each of the sensors in the packaged heating and/or cooling units 155.

As shown in FIG. 6, each of the packaged heating and/or cooling units 155 is operating. A first of the packaged heating and/or cooling unit 155 is operating in a heating mode, while the second packaged heating and/or cooling unit 155 is operating in a cooling mode. That is, for the first packaged heating and/or cooling unit 155, the BAS main controller 10 sends a heating control request, e.g., setpoint or operational mode request, to the production module 145 to heat a conditioned space. The central controller 600 and/or the unit controller instructs the first packaged heating and/or cooling unit 155 to operate the heat pump 175 in a heating mode and to connect the feed valve(s) 150 to the hot water return line 105 to feed the hot water return to the packaged heating and/or cooling unit 155 and the return valve(s) 150 to the hot water supply line 110 to supply the heated hot water return. The central controller 600 and/or the unit controller can also control operation of pump 170 to provide a flow of the process fluid to the heat pump 175.

Similarly, for the second packaged heating and/or cooling unit 155, the BAS main controller 10 sends a cooling control request, e.g., setpoint or operational mode request, to the production module 145 to cool a conditioned space. The central controller 600 and/or the unit controller instructs the second packaged heating and/or cooling unit 155 to operate the heat pump 175 in a cooling mode and to connect the feed valve(s) 150 to the cold water return line 125 to feed the cold water return to the packaged heating and/or cooling unit 155 and the return valve(s) 150 to the cold water supply line 130 to supply the cooled cold water return. The central controller 600 and/or the unit controller can instruct the operation of pump 170 to provide a flow of the process fluid to the heat pump 175.

In this embodiment, either of the packaged heating and/or cooling units 155 can be used to provide either heating or cooling depending on the heating/cooling requirements of the HVACR system based on control signals from the BAS main controller 10. For example, during a shoulder season, e.g., the months between peak season and the offseason, the heating and/or cooling requirements of the building may change during the day. As such, while the first packaged heating and/or cooling unit 155 may be operated in a heating mode and the second packaged heating and/or cooling unit 155 may be operated in a cooling mode, if the heating and/or cooling requirements of the building changes, e.g., during the evening, and more heating is needed, the central controller 600 of the production module 145 can instruct the second packaged heating and/or cooling unit 155 to change its operational mode from cooling to heating to supplemental the heating of the conditioned space(s) of the building.

As such, by having packaged heating and/or cooling units 155 that can operate in either a heating mode or a cooling mode, a dual-feed system is provided that can be decoupled/coupled from the hot water circuit and/or the cold water circuit, as needed. Such a configuration has at least the following advantages:

1) Supports simultaneous heating and cooling distribution;
2) Sequencing flexibility since any unit can be used at any time;
3) Runtime equalization by allowing either unit to be run for set periods of time;
4) Flexible and simple fail-over for capacity redundancy—e.g., any unit can be used for failure recovery;
5) If a small chiller of a unit is applied to improve system capacity turndown, it can support low load operation in either mode;
6) Dedicated variable-speed pumps enable optimization of the process fluid flow;
7) The tempering valve provides an easy and efficient manner to control the heat pump within operational limits;
8) The feed valve(s) and the return valve(s) are simple two position valves, e.g., not modulating;
9) The unit controller, e.g., Symbio 800 by Trane Commercial, can be programmed at the factory or manufacturer to control the valves and pumps of the packaged unit to simplify application and startup, reduce installation costs, and provide better repeatability and standardization of installation; and
10) By providing the unit controller to distributively control the packaged unit, the connection and control by the BAS main controller is simplified.

While the above description has been discussed with respect to a feed valve(s) and return valve(s) to connect to a hot water circuit or cold water circuit, it is appreciated that additional process fluid circuits can be provided to supply thermal loads to different temperature circuits. In an embodiment, the process fluid circuit can include a cool water circuit, in which a triple-feed system is provided, so that the requisite temperature is provided for each load. It is appreciated that any number of process fluid circuits, e.g., quad-feed, quint-feed, sext-feed, etc., can be provided depending on the heating and/or cooling requirements for the HVACR system, and is not intended to be limited by the disclosure herein. While an embodiment is discussed below is related to a cool water circuit, it is appreciated that other temperature circuits can be provided in a similar manner, e.g., warm water, cooler water, etc., based on the load for the HVACR system.

Figure 7:
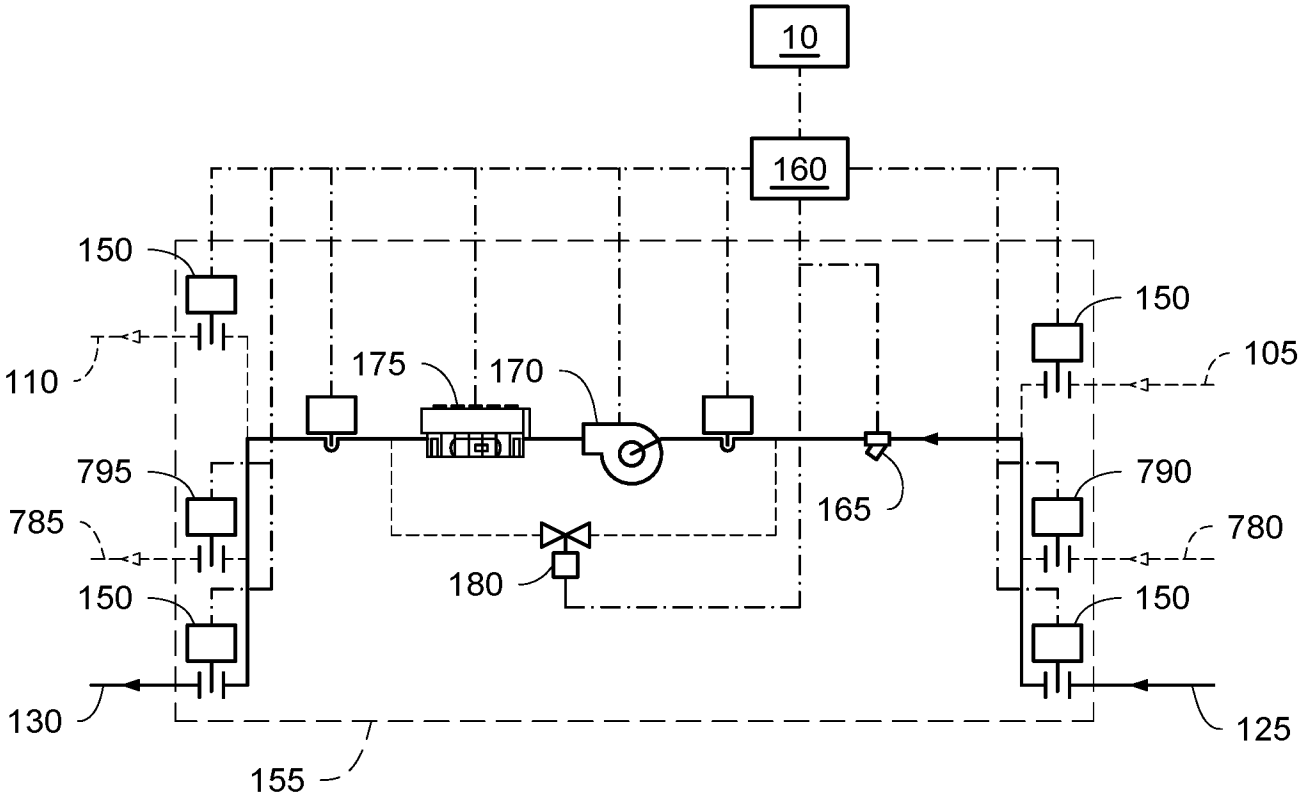
FIG. 7 is a schematic view of a packaged unit with a triple-feed system, according to an embodiment.

As seen in FIG. 7, in an embodiment, a triple-feed system is provided that includes the hot water circuit, the cold water circuit, and a cool water circuit. Similar to the above embodiments, the hot water circuit includes a hot water return line 105 and a hot water supply line 110, while the cold water circuit includes a cold water return line 125 and a cold water supply line 130. Additionally, FIG. 7 includes a cool water circuit that includes a cool water return line 780 and a cool water supply line 785.

In this embodiment, the unit controller 160 can receive a control request to operate in any of a heating mode, a cooling mode, or a cool mode from the BAS main controller to heat and/or cool a conditioned space, e.g., in the building, for a requisite load condition. If the BAS main controller requests the packaged heating and/or cooling unit 155 to operate in a cooling mode, the unit controller 160 can operate feed valve 150 to connect the cold water return line 125 to feed the cold water return to the packaged heating and/or cooling unit 155 and return valve 150 to connect the cooled cold water return to the cold water supply line 130. The unit controller 160 can instruct or confirm that the heat pump 175 is operating in a cooling mode, e.g., using the refrigerant to release heat to the ambient environment. The unit controller 160 can also operate pump 170 to provide a flow of the process fluid to the heat pump 175. If the BAS main controller requests the packaged heating and/or cooling unit 155 to operate in a cool mode, the unit controller 160 can operate feed valve 790 to connect the cool water return line 780 to feed the cool water return to the packaged heating and/or cooling unit 155 and return valve 795 to connect the cooled cool water return to the cool water supply line 785. The unit controller 160 can instruct or confirm that the heat pump 175 is operating in a cool mode, e.g., using the refrigerant to release heat to the ambient environment.

In the embodiments as discussed above, it is understood that the same packaged heating and/or cooling unit 155 can be selectively operated in a heating mode, cooling mode, or the cool mode and is able to be selectively controlled to connect to any one of the hot water circuit, the cold water circuit, or the cool water circuit. As such, a simple and flexible design of a production module having a heat pump is provided that has plug-and-ready design type connections.

It is appreciated that while the feed valves and return valves are shown connected to the different piping for the respective heating water circuit, cold water circuit, and cool water circuit, the circuits may be connected to a single valve to supply and/or return the respective process fluid at the required temperature for the heating and/or cooling requirements for the HVACR system.

Figure 8:
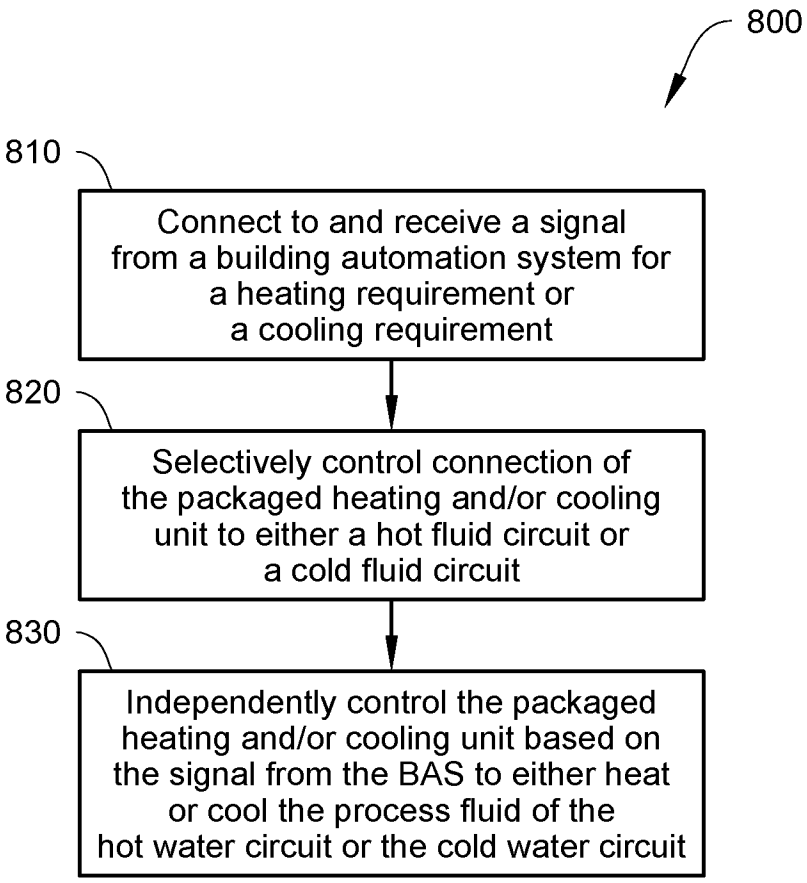
FIG. 8 is a schematic view of a control method of a packaged heating and/or cooling unit, according to an embodiment.

FIG. 8 illustrates a schematic view of a method 800 for controlling a packaged heating and/or cooling unit for a production module for a heating, ventilation, air condition, and refrigeration (HVACR) system, according to an embodiment.

The method 800 may include one or more operations, actions, or functions 810-830. As shown in FIG. 8, the method 800 includes step 810 to connect to and receive a signal from a building automation system for a heating requirement or a cooling requirement. As discussed above, with respect to the other embodiments, it is appreciated that since the unit controller of the packaged heating and/or cooling unit is connected to the BAS main controller and the BAS main controller is not connected directly with the end devices or components of the packaged heating and/or cooling unit, the packaged heating and/or cooling unit can distributively control its own components so that not only is the design of, connection to, and control of the packaged unit to the BAS simplified, the repeatability, standardization of connections, and sustainability of the control is increased and a more responsive control is provided since the control of the unit is provided at the unit level. The method then proceeds to 820.

At 820, the unit controller selectively controls connection of the packaged heating and/or cooling unit to either a hot fluid circuit or a cold fluid circuit, based on the requested load requirement by the BAS main controller for the HVACR system. For example, the HVACR system may need to cool a conditioned space in a building. As such, the BAS main controller can send a cooling mode signal or a setpoint temperature to the unit controller of the packaged heating and/or cooling unit. The packaged heating and/or cooling unit can then control the required components to connect to the appropriate circuit, e.g., hot water circuit or cold water circuit, for example, opening the feed valve(s) and/or the return valve(s) on the appropriate circuit and provide the necessary heating or cooling. The method then proceeds to 830.

At 830, the unit controller independently controls the packaged heating and/or cooling unit based on the signal from the BAS to either heat or cool the process fluid of the hot water circuit or the cold water circuit. For example, the unit controller can control the heat pump to be operate in either the cooling mode or heating mode by reversing the direction of the refrigerant in the heat pump to either release heat or absorb heat from the ambient environment.

In an embodiment, the method can include additional steps, for example, the method can additionally include adjusting a recirculation of a process fluid flow through the heat pump to temper the temperature of the process fluid entering the heat pump, controlling the speed of the pump to vary or adjust the flow of process fluid for heat exchange with the heat pump, controlling the compressor speed of the compressor to provide the requisite load for the HVACR system, controlling the speed of any fan(s) in the heat pump to control airflow to condense or evaporate the working fluid to provide the necessary heating or cooling to the process fluid, and selecting another packaged heating and/or cooling unit to provide redundant operation of the packaged unit in case of failure of the packaged heating and/or cooling unit or supplement the heating and/or cooling needs for the HVACR system.

Aspects: It is appreciated that any one of aspects 1-8 and any one of aspects 9-14 or 15 or 16 can be combined with each other.

Aspect 1. A packaged heating and/or cooling unit for a production module for a heating, ventilation, air conditioning, and refrigeration (HVACR) system, the packaged heating and/or cooling unit comprising: a heat pump configured to provide heating and/or cooling to the fluid; a connection to a piping distribution system to selectively connect to a hot fluid circuit and/or a cold fluid circuit; and a controller configured to connect to and receive a signal from a building automation system for a heating requirement or a cooling requirement, and further configured to selectively control connection to either the hot fluid circuit or the cold fluid circuit and independently control the packaged heating and/or cooling unit based on the signal from the building automation system for either the heating requirement or the cooling requirement.

Aspect 2. The packaged heating and/or cooling unit of Aspect 1, further comprising a pump configured to pump a fluid through the packaged heating and/or cooling unit.

Aspect 3. The packaged heating and/or cooling unit of Aspects 1 or 2, further comprising a tempering valve configured to temper an entrance fluid temperature of the fluid to the packaged heating and/or cooling unit.

Aspect 4. The packaged heating and/or cooling unit of any of Aspects 1-3, further comprising a strainer between the fluid pump and the piping distribution system.

Aspect 5. The packaged heating and/or cooling unit of any of Aspect 2, wherein the pump is a variable speed pump.

Aspect 6. The packaged heating and/or cooling unit of any of Aspects 1-5, further comprising a sensor on a fluid inlet and/or outlet piping to detect at least a temperature and/or pressure and/or flow rate in the packaged heating and/or cooling unit, wherein the controller is configured to adjust a speed of a compressor of the heat pump and/or the pump based on the detected temperature and/or pressure and/or flow rate.

Aspect 7. The packaged heating and/or cooling unit of any of Aspects 1-6, wherein the piping distribution system is selected from a dual feed piping or a triple feed piping arrangement to supply the fluid to at least the hot fluid circuit, the cold fluid circuit, and/or a cool fluid circuit.

Aspect 8. The packaged heating and/or cooling unit of any of Aspects 1-7, wherein the heat pump unit further comprises a fan configured to control airflow to condense or evaporate the working fluid.

Aspect 9. A production module for a heating, ventilation, air conditioning, and refrigeration (HVACR) system, the production module comprising at least two of the packaged heating and/or cooling units according to any of Aspects 1-8 and a production module controller, wherein the production module controller is configured to receive the signal from the building automation system for the heating requirement or the cooling requirement and select at least one of the two packaged heating and/or cooling units for either the heating requirement or the cooling requirement.

Aspect 10. The production module according to Aspect 9, wherein the signal is a temperature setpoint for either the hot fluid circuit or the cold fluid circuit, and wherein the selected packaged heating and/or cooling units is distributively controlled to maintain the temperature setpoint.

Aspect 11. The production module according to any of Aspects 9-10, wherein the signal is a temperature setpoint for the hot fluid circuit and a temperature setpoint for the cold fluid circuit, and wherein the respective controller of the at least two packaged heating and/or cooling units is configured to control the respective packaged heating and/or cooling unit to maintain the respective temperature setpoint for the hot fluid circuit or the respective temperature setpoint for the cold fluid circuit.

Aspect 12. The production module according to any of Aspects 9-11, wherein the production module controller is further configured to, when the selected packaged heating and/or cooling unit fails, select another packaged heating and/or cooling unit for the designated heating requirement or the cooling requirement.

Aspect 13. The production module according to any of Aspects 9-12, wherein when the signal from the building automation system is for the cooling requirement and the selected packaged heating and/or cooling unit has a predetermined fluid flow rate equal to or higher than a minimum allowed flow for the heat pump, another packaged heating and/or cooling unit is signaled for operation for the cooling requirement, and wherein the production module controller is further configured to implement a variable primary and variable secondary flow control logic between the selected packaged heating and/or cooling unit and the another packaged heating and/or cooling unit to provide the cooling requirement.

Aspect 14. The production module according to any of Aspects 9-13, wherein when the signal from the building automation system is for the heating requirement and the selected packaged heating and/or cooling unit has a second predetermined fluid design flow rate equal to or higher than a minimum allowed flow for the heat pump, another packaged heating and/or cooling unit is signaled for operation for the heating requirement, and wherein the production module controller is further configured to implement a variable primary and variable secondary flow control logic between the selected packaged heating and/or cooling unit and the another packaged heating and/or cooling unit to provide the heating requirement.

Aspect 15. A controller for a packaged heating and/or cooling unit for a production module for a heating, ventilation, air condition, and refrigeration (HVACR) system, the controller being configured to: connect to and receive a signal from a building automation system for a heating requirement or a cooling requirement, control connection of the packaged heating and/or cooling unit to either a hot fluid circuit or a cold fluid circuit, and independently control the packaged heating and/or cooling unit based on the signal from the building automation system for either the heating requirement or the cooling requirement, wherein the packaged heating and/or cooling unit comprises a pump, a heat pump, and a connection to a piping distribution system.

Aspect 16. A method to control a packaged heating and/or cooling unit for a production module for a heating, ventilation, air condition, and refrigeration (HVACR) system, the method comprising: connecting to and receiving a signal from a building automation system for a heating requirement or a cooling requirement, selectively controlling connection of the packaged heating and/or cooling unit to either a hot fluid circuit or a cold fluid circuit, and independently controlling the packaged heating and/or cooling unit based on the signal from the building automation system for either the heating requirement or the cooling requirement, wherein the packaged heating and/or cooling unit comprises a pump, a heat pump, and a connection to a piping distribution system.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A production module for a heating, ventilation, air conditioning, and refrigeration (HVACR) system, the production module comprising:

at least two packaged heating and/or cooling units, wherein each of the at least two packaged heating and/or cooling units comprises:

a heat pump configured to provide heating and/or cooling to the fluid;

a connection to a piping distribution system to selectively connect to a hot fluid circuit and/or a cold fluid circuit; and a controller configured to connect to and receive a signal from a building automation system for a heating requirement or a cooling requirement, and further configured to selectively control connecting to either the hot fluid circuit or the cold fluid circuit and independently control the packaged heating and/or cooling unit based on the signal from the building automation system for either the heating requirement or the cooling requirement;

a production module controller, wherein the production module controller is connected to the controller for each of the at least two packaged heating and/or cooling units and is configured to receive the signal from the building automation system for the heating requirement or the cooling requirement and select at least one of the at least two packaged heating and/or cooling units for either the heating requirement or the cooling requirement by sending the signal to the controller of the selected packaged heating and/or cooling unit.

2. The production module of claim 1, wherein each of the packaged heating and/or cooling units further comprise a pump configured to pump a fluid through the respective packaged heating and/or cooling unit.

3. The production module of claim 1, wherein each of the packaged heating and/or cooling units further comprise a tempering valve configured to temper an entrance fluid temperature of the fluid to the packaged heating and/or cooling unit.

4. The production module of claim 2, wherein each of the packaged heating and/or cooling units further comprises a strainer between the fluid pump and the piping distribution system.

5. The production module of claim 2, wherein the pump is a variable speed pump.

6. The production module of claim 2, wherein each of the at least two packaged heating and/or cooling units further comprise a sensor on a fluid inlet and/or outlet piping to detect at least a temperature and/or pressure and/or flow rate in the packaged heating and/or cooling unit, wherein the controller is configured to adjust a speed of a compressor of the heat pump and/or the pump based on the detected temperature and/or pressure and/or flow rate.

7. The production module of claim 1, wherein the piping distribution system is selected from a dual feed piping or a triple feed piping arrangement to supply the fluid to at least the hot fluid circuit, the cold fluid circuit, and/or a cool fluid circuit.

8. The production module of claim 1, wherein for each of the at least two packaged heating and/or cooling units, the heat pump unit further comprises a fan configured to control airflow to condense or evaporate the working fluid.

9. The production module according to claim 1, wherein the signal is a temperature setpoint for either the hot fluid circuit or the cold fluid circuit, and wherein the selected packaged heating and/or cooling units is distributively controlled to maintain the temperature setpoint.

10. The production module according to claim 1, wherein the signal is a temperature setpoint for the hot fluid circuit and a temperature setpoint for the cold fluid circuit, and wherein the respective controller of the at least two packaged heating and/or cooling units is configured to control the respective packaged heating and/or cooling unit to maintain the respective temperature setpoint for the hot fluid circuit or the respective temperature setpoint for the cold fluid circuit.

11. The production module according to claim 1, wherein the production module controller is further configured to, when the selected packaged heating and/or cooling unit fails, select another packaged heating and/or cooling unit for the designated heating requirement or the cooling requirement.

12. The production module according to claim 1, wherein when the signal from the building automation system is for the cooling requirement and the selected packaged heating and/or cooling unit has a predetermined fluid flow rate equal to or higher than a minimum allowed flow for the heat pump, another packaged heating and/or cooling unit is signaled for operation for the cooling requirement, and wherein the production module controller is further configured to implement a variable primary and variable secondary flow control logic between the selected packaged heating and/or cooling unit and the another packaged heating and/or cooling unit to provide the cooling requirement.

13. The production module according to claim 1, wherein when the signal from the building automation system is for the heating requirement and the selected packaged heating and/or cooling unit has a second predetermined fluid design flow rate equal to or higher than a minimum allowed flow for the heat pump, another packaged heating and/or cooling unit is signaled for operation for the heating requirement, and wherein the production module controller is further configured to implement a variable primary and variable secondary flow control logic between the selected packaged heating and/or cooling unit and the another packaged heating and/or cooling unit to provide the heating requirement.

14. A production module controller for a production module for a heating, ventilation, air conditioning, and refrigeration (HVACR) system, the production module comprising at least two packaged heating and/or cooling units, the production module controller being configured to:

connect to and receive a signal from a building automation system for a heating requirement or a cooling requirement, select at least one of the at least two packaged heating and/or cooling units for either a heating requirement or a cooling requirement by sending the signal to a controller of the selected packaged heating and/or cooling unit such that the controller is configured to control connection of the selected packaged heating and/or cooling unit to a piping distribution system to selectively connect to a hot fluid circuit and/or a cold fluid circuit and to control operation of a heat pump of the selected heating and/or cooling unit, wherein the controller of the selected packaged heating and/or cooling unit is configured to independently control the selected packaged heating and/or cooling unit including the heat pump based on the signal from the production module controller for either the heating requirement or the cooling requirement.

15. A method to control a production module a heating, ventilation, air condition conditioning, and refrigeration (HVACR) system, the production module comprising at least two packaged heating and/or cooling units and a production module controller, the method comprising:

connecting to and receiving, via the production module controller, a signal from a building automation system for a heating requirement or a cooling requirement, selecting at least one of the at least two packaged heating and/or cooling units for either a heating requirement or a cooling requirement by sending the signal to a controller of the selected packaged heating and/or cooling unit such that the controller is configured to selectively control connection of the selected packaged heating and/or cooling unit to a piping distribution system to selectively connect to a hot fluid circuit and/or a cold fluid circuit and controlling operation of a heat pump of the selected heating and/or cooling unit, and wherein the controller of the selected heating and/or cooling unit is configured to independently control the selected packaged heating and/or cooling unit based on the signal from the production module controller for either the heating requirement or the cooling requirement.

* * * * *